US008878037B2

(12) United States Patent
Van Leggelo

(10) Patent No.: US 8,878,037 B2
(45) Date of Patent: Nov. 4, 2014

(54) MUSICAL INSTRUMENT MECHANICALLY ACTIVATED

(76) Inventor: Alphonse Emile Van Leggelo, Guaratingueta (BR)

( * ) Notice: Subject to any disclaimer, the term of this patent is extended or adjusted under 35 U.S.C. 154(b) by 184 days.

(21) Appl. No.: 13/393,711

(22) PCT Filed: Sep. 1, 2010

(86) PCT No.: PCT/BR2010/000294
§ 371 (c)(1),
(2), (4) Date: Mar. 1, 2012

(87) PCT Pub. No.: WO2011/026208
PCT Pub. Date: Mar. 10, 2011

(65) Prior Publication Data

US 2012/0152084 A1 Jun. 21, 2012

(30) Foreign Application Priority Data

Sep. 2, 2009 (BR) ..... 0903267-3

(51) Int. Cl.
*G10D 13/08* (2006.01)

(52) U.S. Cl.
CPC ..... *G10D 13/085* (2013.01)
USPC ..... 84/404

(58) Field of Classification Search
USPC ..... 84/402–410
See application file for complete search history.

(56) References Cited

U.S. PATENT DOCUMENTS 2,206,837 A * 7/1940 Edwards ..... 84/405
2,215,358 A 9/1940 Konikoff
3,443,469 A 5/1969 Yoichi

FOREIGN PATENT DOCUMENTS

FR 753712 A 10/1933

OTHER PUBLICATIONS

International Search Report for PCT/BR2010/000294, mailed Mar. 3, 2011, 2 pages.

* cited by examiner

*Primary Examiner* — Kimberly Lockett
(74) *Attorney, Agent, or Firm* — William J. Sapone; Ware Fressola Maguire & Barber LLP

(57) ABSTRACT

A mechanically activated musical instrument mainly for public use is preferably installed in open areas such as parks, plazas, cultural centers and the like. The mechanically activated musical instrument has similarities with a carillon, but having a mechanical activation system handled directly by one or more persons. The mechanically activated musical instrument has a sustentation structure (2), multiple sound tubes (3), multiple support structures (4) and multiple actuation mechanisms (5). The mechanically activated musical instrument (1) has a configuration in which the multiple sound tubes (3), the multiple support structures (4) and the multiple actuation mechanisms (5) are arranged on one face of the sustentation structure with the multiple sound tubes (3) disposed parallel to the face of the sustentation structure (2).

24 Claims, 19 Drawing Sheets

MUSICAL INSTRUMENT MECHANICALLY ACTIVATED

TECHNICAL FIELD

The present invention discloses a musical instrument mechanically activated.

Specifically, the present invention discloses a musical instrument mainly for public use, preferably installed in open areas such as parks, plazas, cultural centers and the like.

The musical instrument herein disclosed, which has similarities with a carillon, has a unique mechanical actuation system, said actuation system handled directly by one or more persons.

BACKGROUND OF THE INVENTION

A classical carillon comprises a musical percussion instrument originally designed in the mid XV century and, at this time, this musical instrument was normally located in towers of churches or convents. The largest concentration of ancient carillons can be found in European countries, especially in Belgium, Holland and Germany.

The original design of a carillon provides a keyboard and a set of bells of various sizes, which are activated by a mechanism controlled by lines attached to keys.

In the original design, each key of the keyboard activates a lever and/or a wire directly connected to a bell-clapper or hammer that, when activated, comes into physical contact with its respective bell.

Over the years the original design of the carillon was modified and optimized.

The symphonic carillon, product of modifications and optimizations of the original carillon, is primarily composed of hollow tubes of different sizes, vertically arranged in a graded manner (with respect to the length of said tubes). Conventionally, the sound of the tubes is extracted by the impact of manual drumsticks, which come into physical contact with said tubes.

Both the classical carillon and the symphonic carillon integrate the current state of the art. Both carillons are usually arranged in closed spaces and played by professional musicians and experts.

The current state of the art provides different configurations of carillons, while the vast majority of these configurations are based on the original carillons, or on the symphonic carillons, or even on the hybrid carillons, which mix the original concept and the symphonic concept. As a relevant example of the current state of the art, the Dutch Patent NL 193916 will be analyzed.

The Dutch Patent NL 193916 of Feb. 18, 1983, discloses a musical instrument mechanically activated, which provides, in part, a similar constructiveness of a classical carillon, and a similar constructiveness of a symphonic carillon.

From a structural point of view, the musical instrument described in Dutch Patent NL 193916 comprises a longitudinal support profile intended for the incorporation of a single element of sound.

The emphasis of this patent refers specifically to the existence of a single longitudinal profile. Multiples of these profiles can be attached to a chassis, or still, be fixed directly to the ground, always in an individual form.

From the functional point of view, the musical instrument described in Dutch Patent NL 193916 provides, in a resumed mode, a pedal attached to a hammer, the engagement point between the key and the hammer being also the point of articulation of both the key and the hammer, and said point of articulation being fixed latitudinally on its respective longitudinal profile.

Therefore, the key is positioned in front of its respective tube, while the hammer is positioned behind the same tube. It can also be seen that the assembly comprising a key and a hammer is always positioned close to the lower end of its respective tube.

Although the object of the Dutch Patent NL 193916 shows a fully functional system, several aspects are susceptible to improvements.

A first aspect that is susceptible to improvement refers to the assembly of said musical instrument. In this type of assembly each element is individually assembled, that is, on each longitudinal profile there is mounted a pipe, a hammer and a key. Each of the longitudinal profiles already assembled can be fixed individually to the ground or on a chassis, to form a complete musical instrument. This factor is extremely undesirable, after all, one can see that this assembly is extremely complicated, as well as being assembled completely manually.

A second aspect susceptible to improvement refers to the fragility of this musical instrument against urban vandalism. By way of an example: This musical instrument is preferably intended for public and collective use, that is, it is installed in plazas and parks. Its configuration allows that the hammers, which cannot be directly handled, are easily accessible. Therefore, said hammers are subject to vandalism, which is extremely undesirable.

A third negative aspect refers to the lack of versatility of the actuation system of the mentioned musical instrument. Each actuation system of the longitudinal profiles is, usually, located close to the lower end of its respective tube due to its constructiveness. Thus, the attachment height of each actuation system (in relation to its respective tube) is always the same, and cannot be changed.

A fourth aspect susceptible to improvement is related to the secondary noises which are produced by the instrument, these noises being generated also due to existing clearances between elements that make up each actuation mechanism.

A fifth aspect susceptible to improvement is related to maintenance and adjustment of said musical instrument. The hammers that integrate the musical instrument of Dutch Patent NL 193916, which are located "behind" their respective tubes, are and/or need to be very carefully adjusted in relation to said tubes. This adjustment makes the contact face of the hammer, when the hammer is activated, to get in a tangential contact with the tube. However, it happens that just a minimum displacement of the hammer already modifies the perfect fit.

Briefly, it can also be affirmed by practice that the musical instrument of Dutch Patent NL 193916 is fragile, and that this fragility is one of its major negative aspects.

The current state of the art also comprises other patents that discloses different types of carillons; however, none of these patents describe a musical instrument free of the negative aspects mentioned above.

The U.S. Pat. No. 2,647,430, of Jul. 25, 1950, discloses a musical instrument with an electric actuation system, also conformed by a frame support chassis fixed/supported on ground. Said chassis also provides latitudinal hardware on its upper portion, while at each end of each latitudinal hardware there is a suspended tube, and over each latitudinal hardware an electric actuation device is fixed, this device consisting of two drumsticks, each one facing a tube. This musical instrument, like the musical instrument of Dutch Patent NL 193916, is fragile and unstable.

The U.S. Pat. No. 1,100,671, of Jun. 16, 1914, discloses a musical instrument with a manual actuation system, which is also composed of a frame support chassis. The tubes are suspended directly from the upper portion of the chassis and secured on the lower part by an inclined latitudinal bar, which has the function of not allowing the movement of said tubes. This musical instrument, like the musical instrument of Dutch Patent NL 193916, is fragile and unstable.

The German Patent DE 2461123, of Dec. 23, 1974, discloses a mechanically activated musical "floor" instrument, which is introduced into a trench (in the ground). This musical instrument provides a fixed wall and a movable wall. The fixed wall, which is directly supported on the ground, provides guide channels (with internal springs) and also has the function of a support base for the actuation lever. The moving wall, which is positioned at the same ground level, provides guide pins and at least one actuation pin. It should also be pointed out that at least one bell is located between the fixed wall and the movable wall. Each bell is activated by an end of the actuation lever when the actuation pin pushes the free end of said actuation lever. This happens when the moving wall is pressed (by the voluntary movement of the foot of a person, for example). This musical instrument, even though relatively stable, is conceptually different from the musical instrument of Dutch Patent NL 193916, and also has a complex actuation mechanism.

Considering all the aspects herein and above explained, the necessity remains clear of creating a musical instrument with an optimized mechanical actuation system and free of the mentioned disadvantages. On basis of this necessity the present Patent of Invention arises.

BRIEF DESCRIPTION OF THE INVENTION

The present Invention Patent was developed to optimize aspects susceptible to improvements in relation to the musical instrument of Dutch Patent NL 193916, and discloses unprecedented improvements made on the musical instrument mechanically activated.

The aforementioned musical instrument mechanically activated consists of a musical instrument preferably for public use, preferably installed in open areas such as parks, plazas, cultural centers and the like.

One of the most relevant and innovative aspects concerns the unprecedented support and sustentation structure of said musical instrument. The support and sustentation structure comprises, basically, an essentially flattened structure, preferably positioned in a vertical orientation and parallel to the sound tubes. The essentially flattened structure may be a monobloc or composed of multiple elements connected to each other.

This constructive concept is responsible for simplifying the assembly and production of the musical instrument, as its elements are directly installed on a single structure. This fact also enhances the transportation of said musical instrument.

Besides the simplicity of the assembly procedure, the flattened structure may also be fixed (in a fixed or detachable manner) parallel to a wall or similar building, increasing even further the degree of stability of the musical instrument.

Another innovative aspect is related to the actuation mechanisms which integrates the present musical instrument. Each actuation mechanism is composed of special elements: each actuation mechanism can be adjusted in height in relation to the tubes which also integrate the musical instrument which is the object of the present invention.

The present musical instrument mechanically activated, is more secure against acts of urban vandalism, due to the layout and location of the mechanisms as a whole, which are inaccessible.

The musical instrument mechanically activated here disclosed has a substantially lower manufacturing cost than the manufacturing cost of the musical instrument of Dutch Patent NL 193916.

BRIEF DESCRIPTION OF THE DRAWINGS

The present invention will now be described in detail based on the figures listed below, in which.

Figure 1:
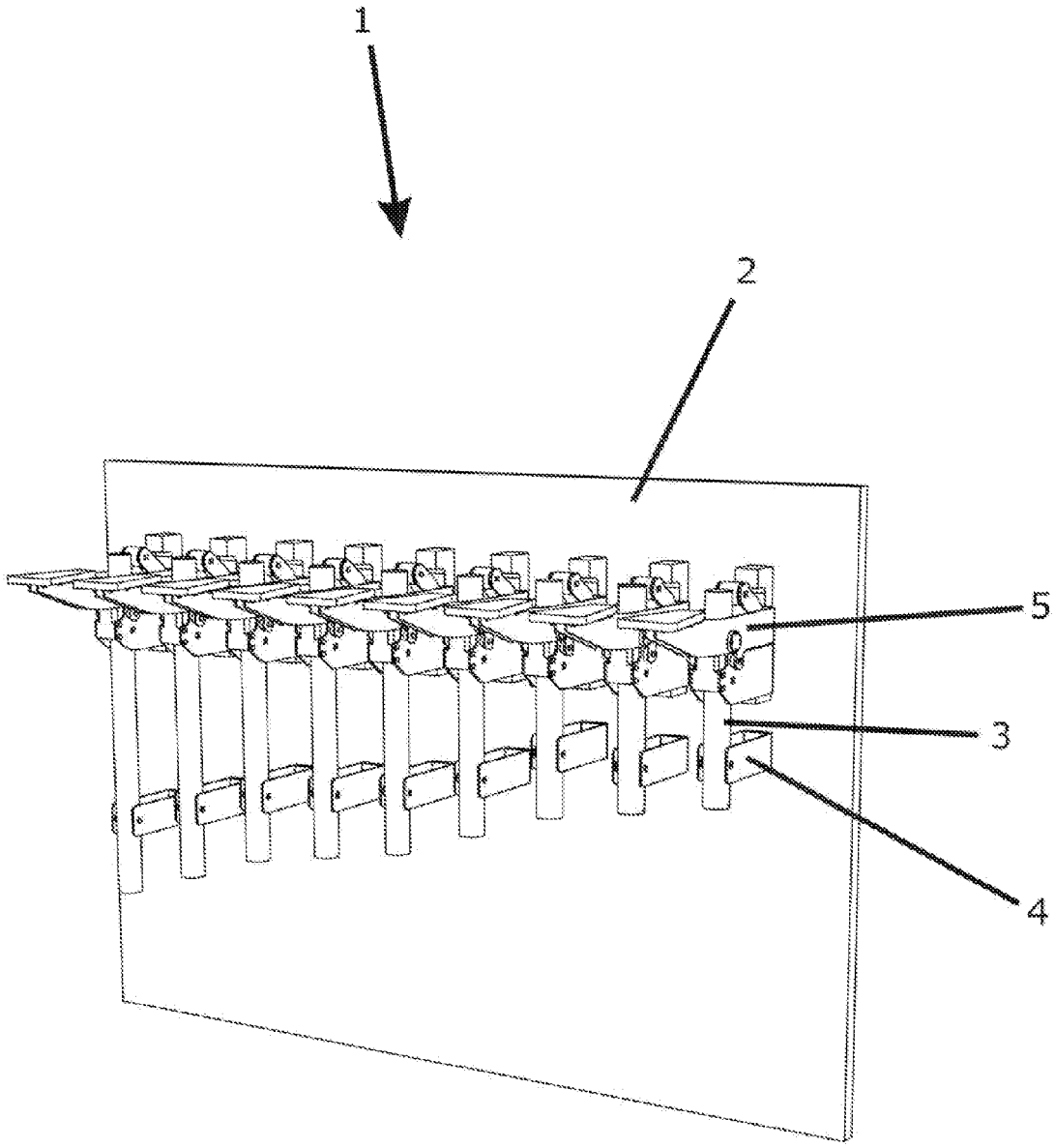
FIG. 1 illustrates the first version of the musical instrument mechanically activated, in a perspective view.
Figure 2:
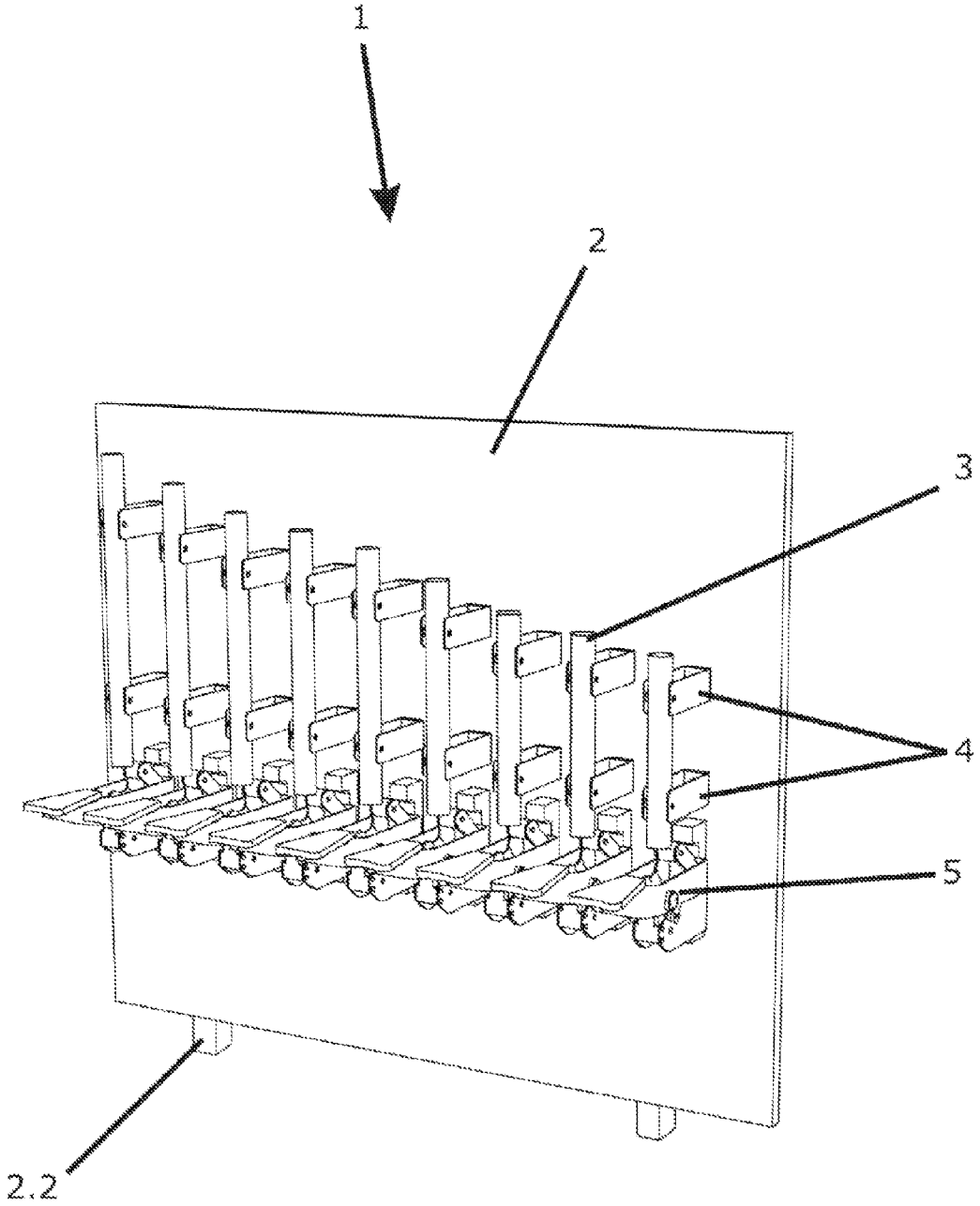
FIG. 2 illustrates the second version of the musical instrument mechanically activated, in a perspective view.
Figure 3:
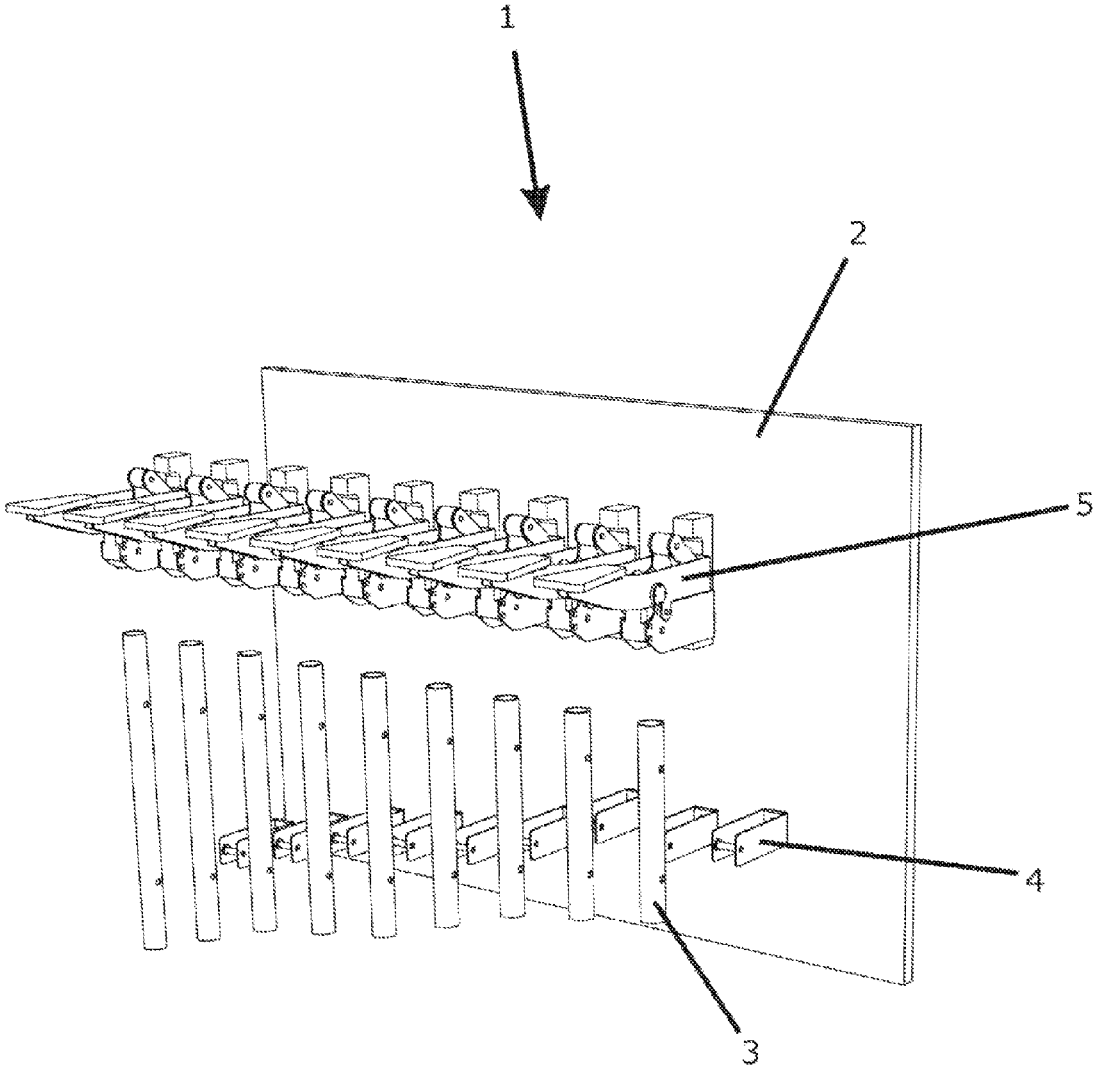
FIG. 3 illustrates the first version of the musical instrument mechanically activated, in an exploded perspective view.
Figure 4:
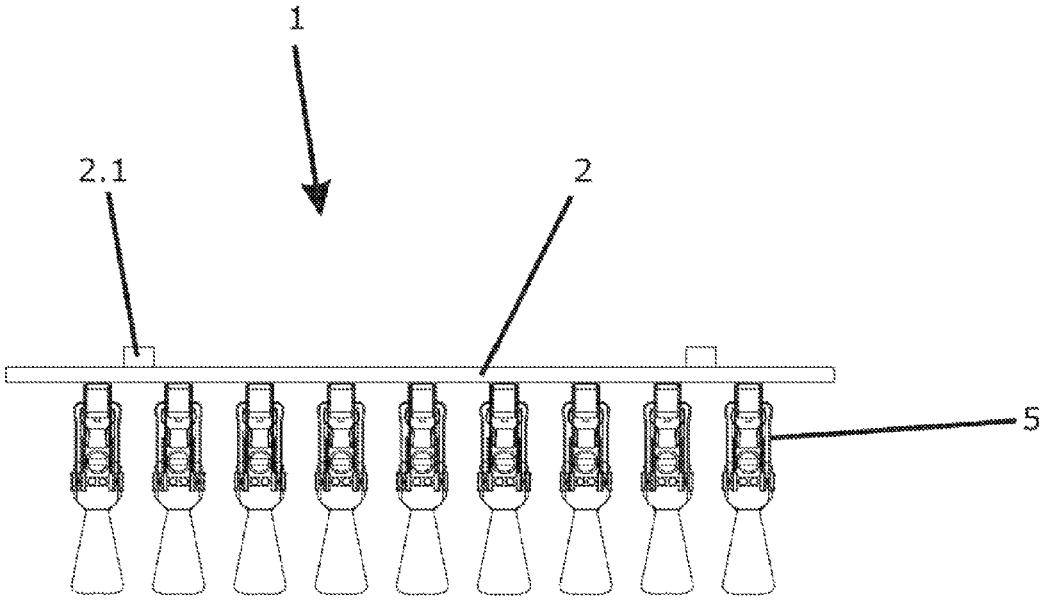
FIG. 4 illustrates the first version of the musical instrument mechanically activated, in a top view.
Figure 5:
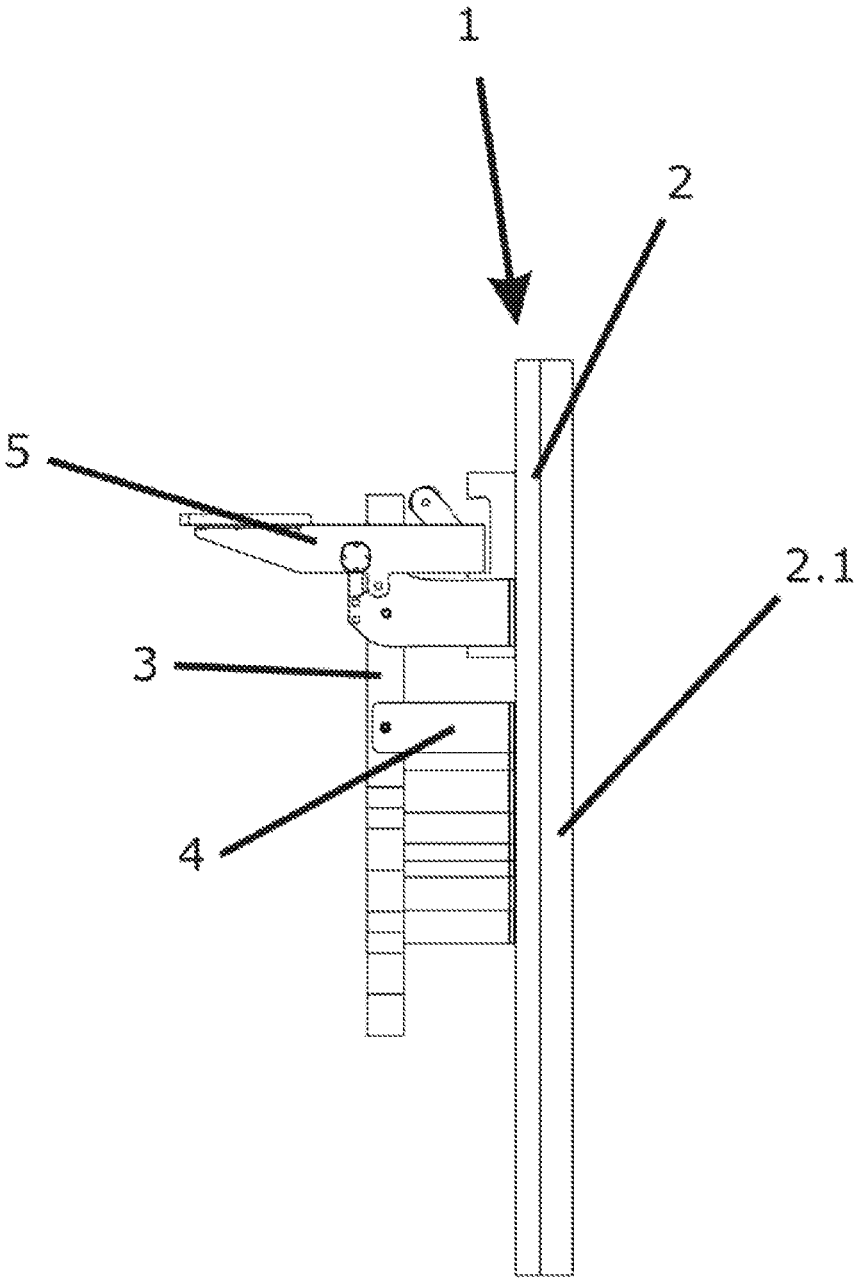
FIG. 5 illustrates the first version of the musical instrument mechanically activated, in a side view.
Figure 6:
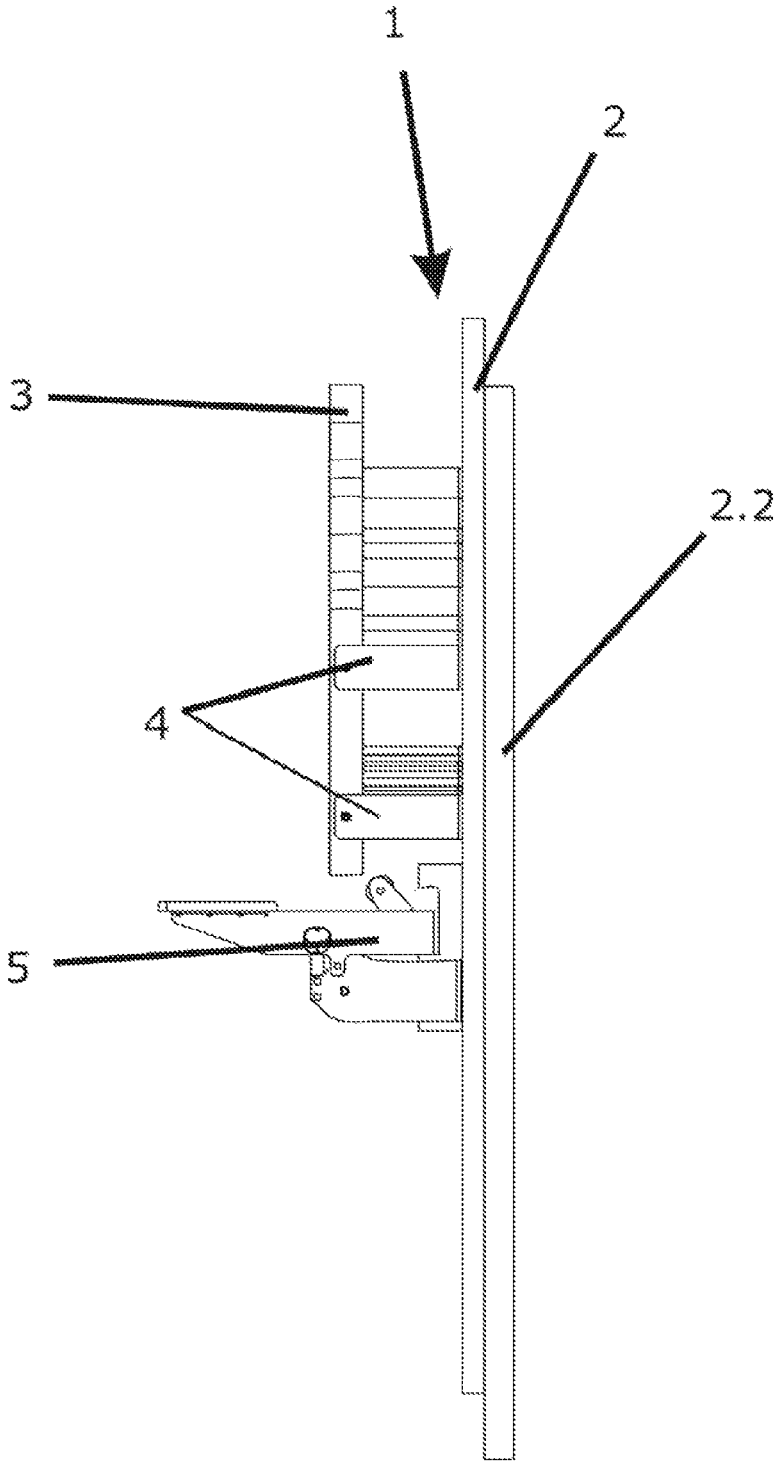
FIG. 6 illustrates the second version of the musical instrument mechanically activated, in a side view.
Figure 7:
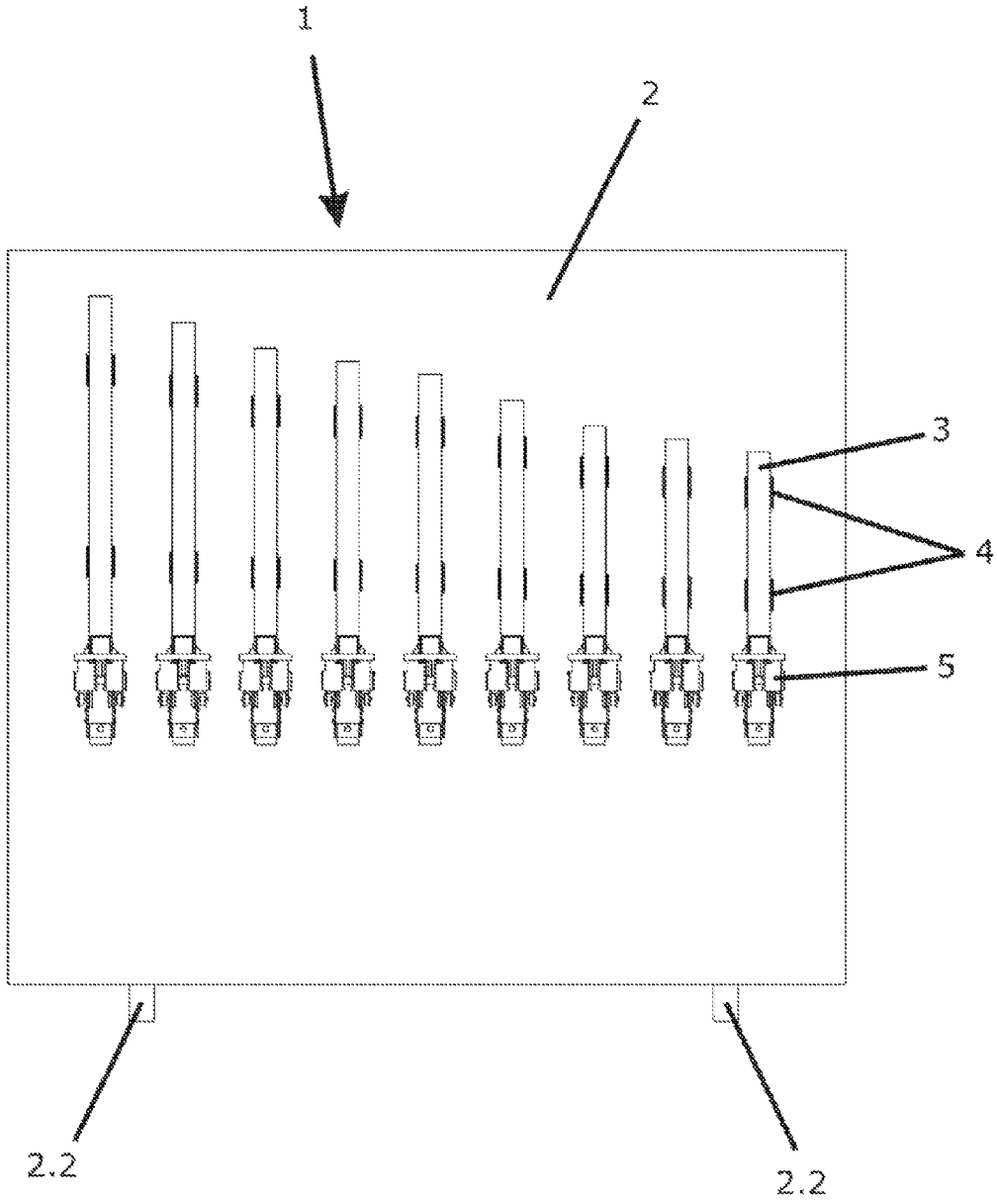
FIG. 7 illustrates the second version of the musical instrument mechanically activated, in a front view.
Figure 8:
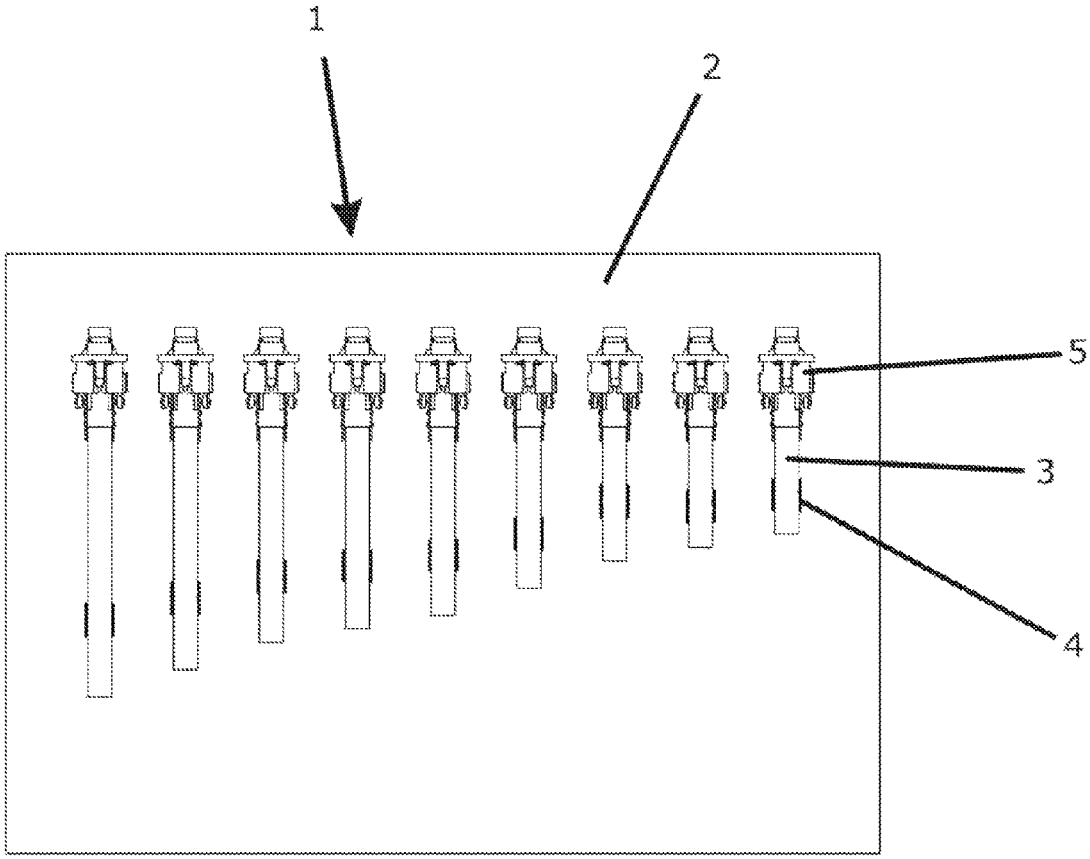
FIG. 8 illustrates the first version of the musical instrument mechanically activated, in a front view.
Figure 9:
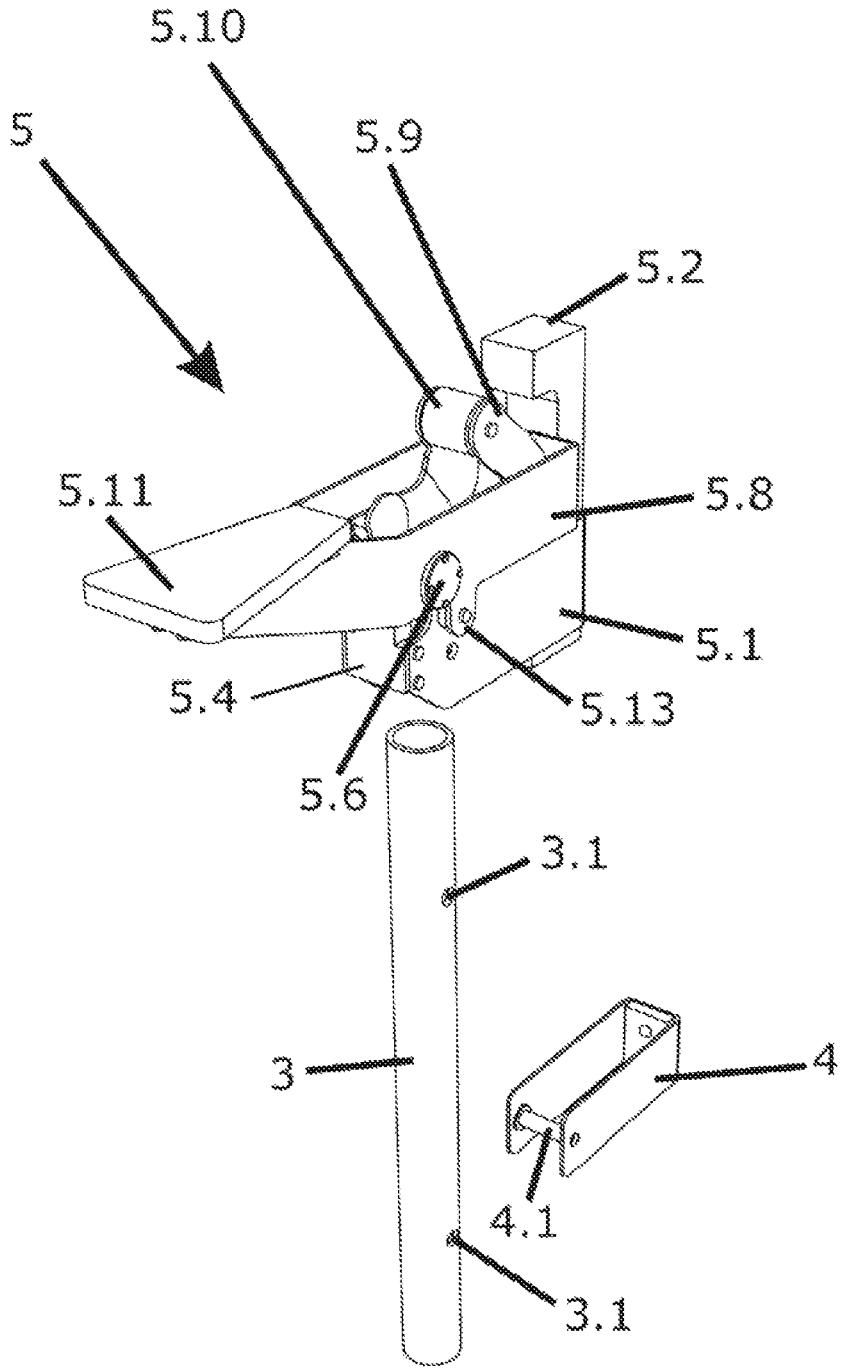
FIG. 9 illustrates a sound tube, a support structure and an actuation mechanism, in a perspective view.
Figure 10:
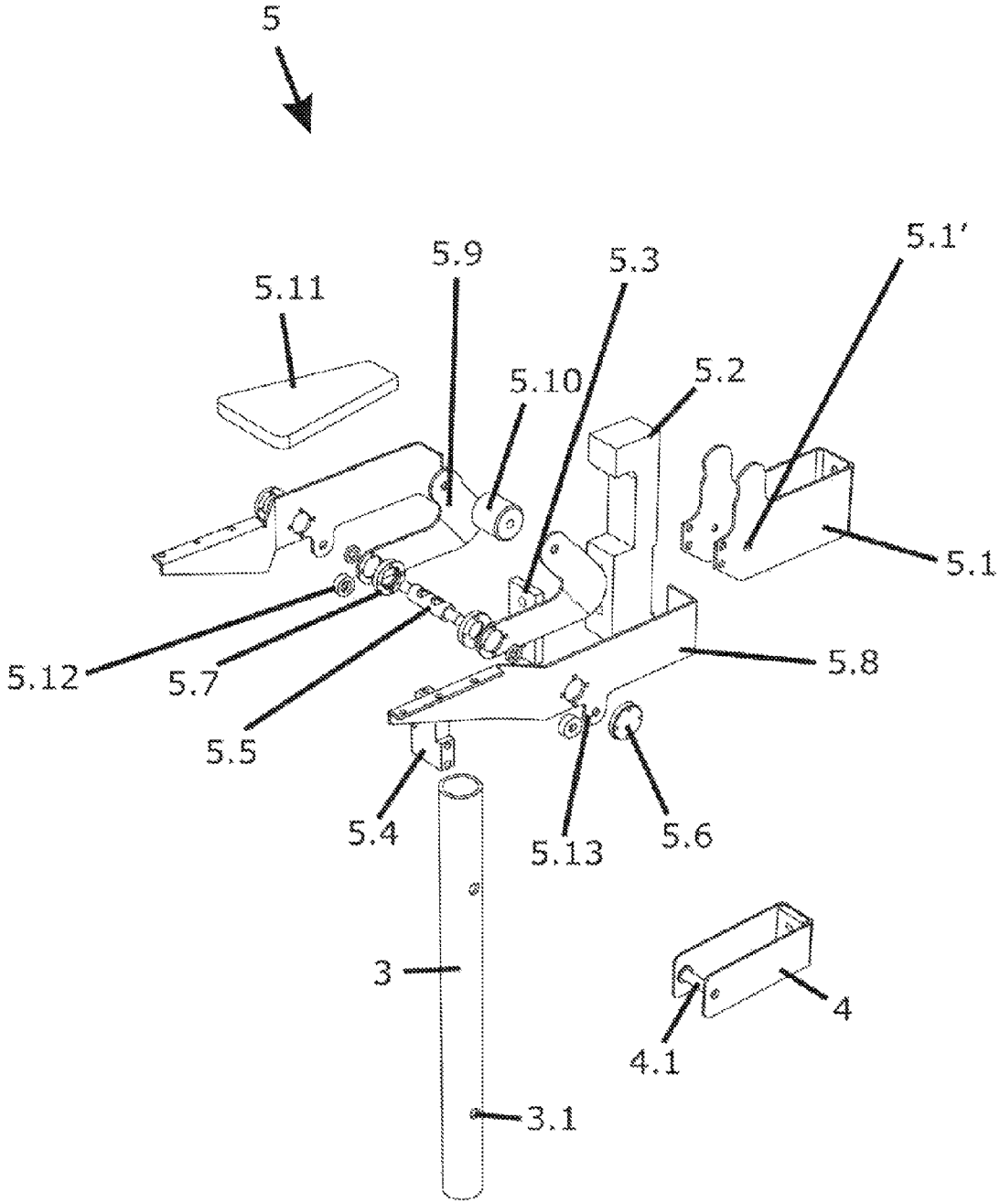
FIG. 10 illustrates a sound tube, a support structure and an actuation mechanism, in an exploded perspective view.
Figure 11:
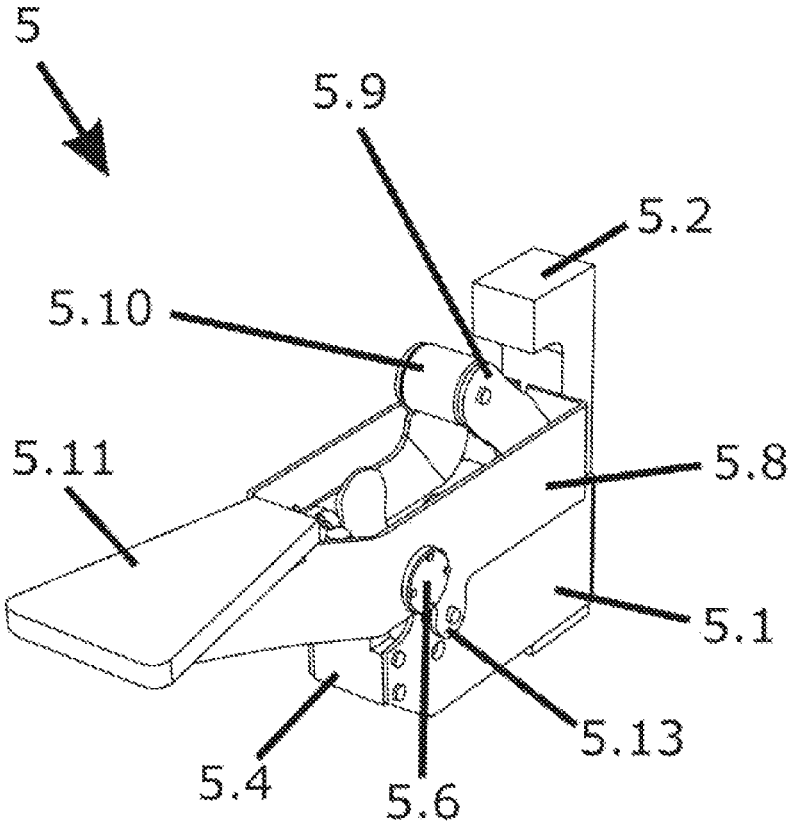
FIG. 11 illustrates an actuation mechanism, in a perspective view.
Figure 12:
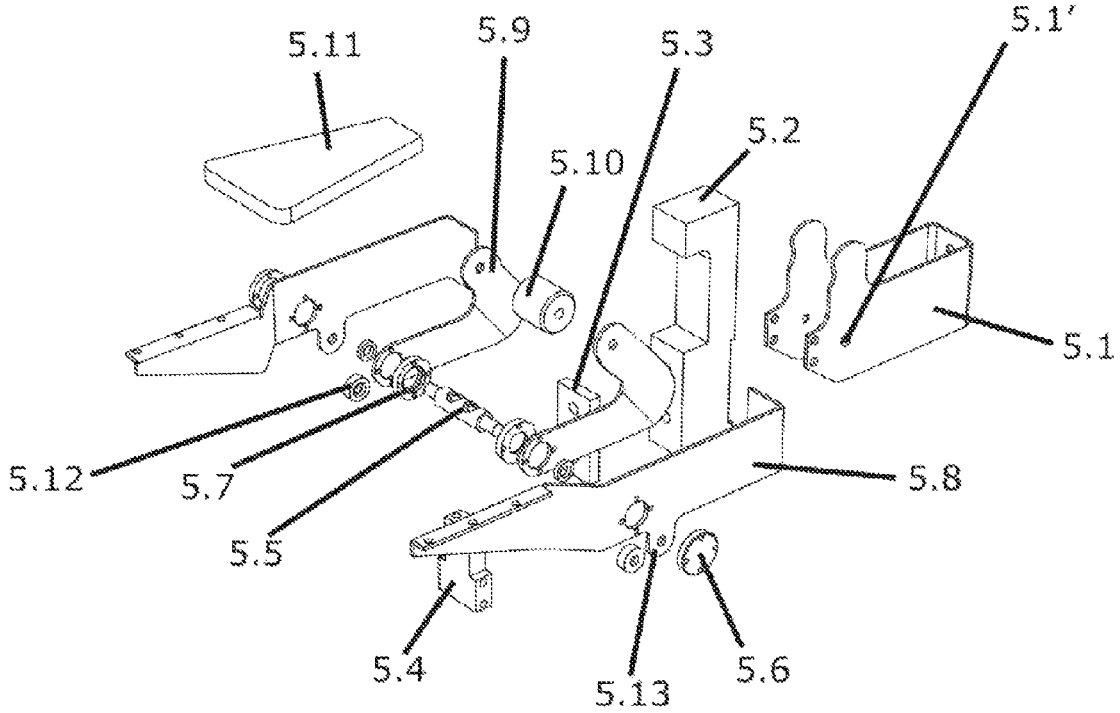
FIG. 12 illustrates an actuation mechanism, in an exploded perspective view.
Figure 13:
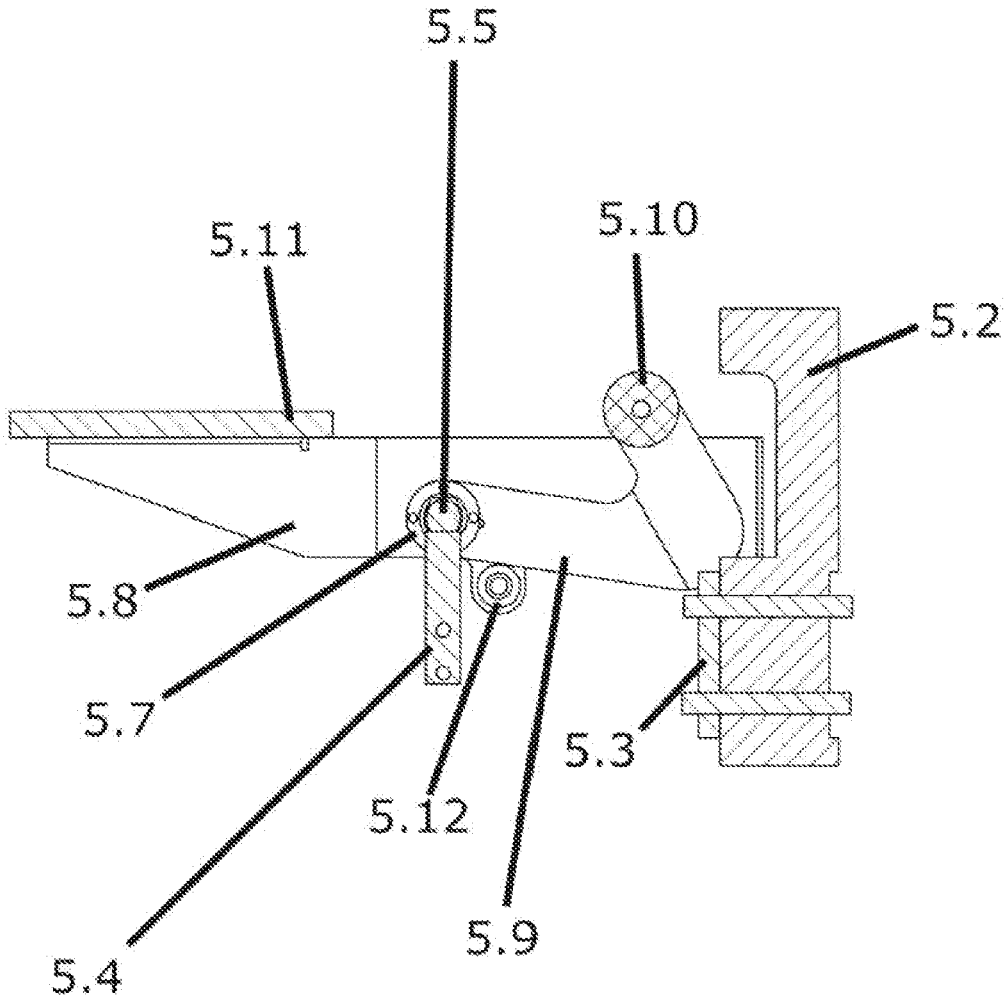
FIG. 13 illustrates a schematic section of the actuation mechanism.
Figure 14:
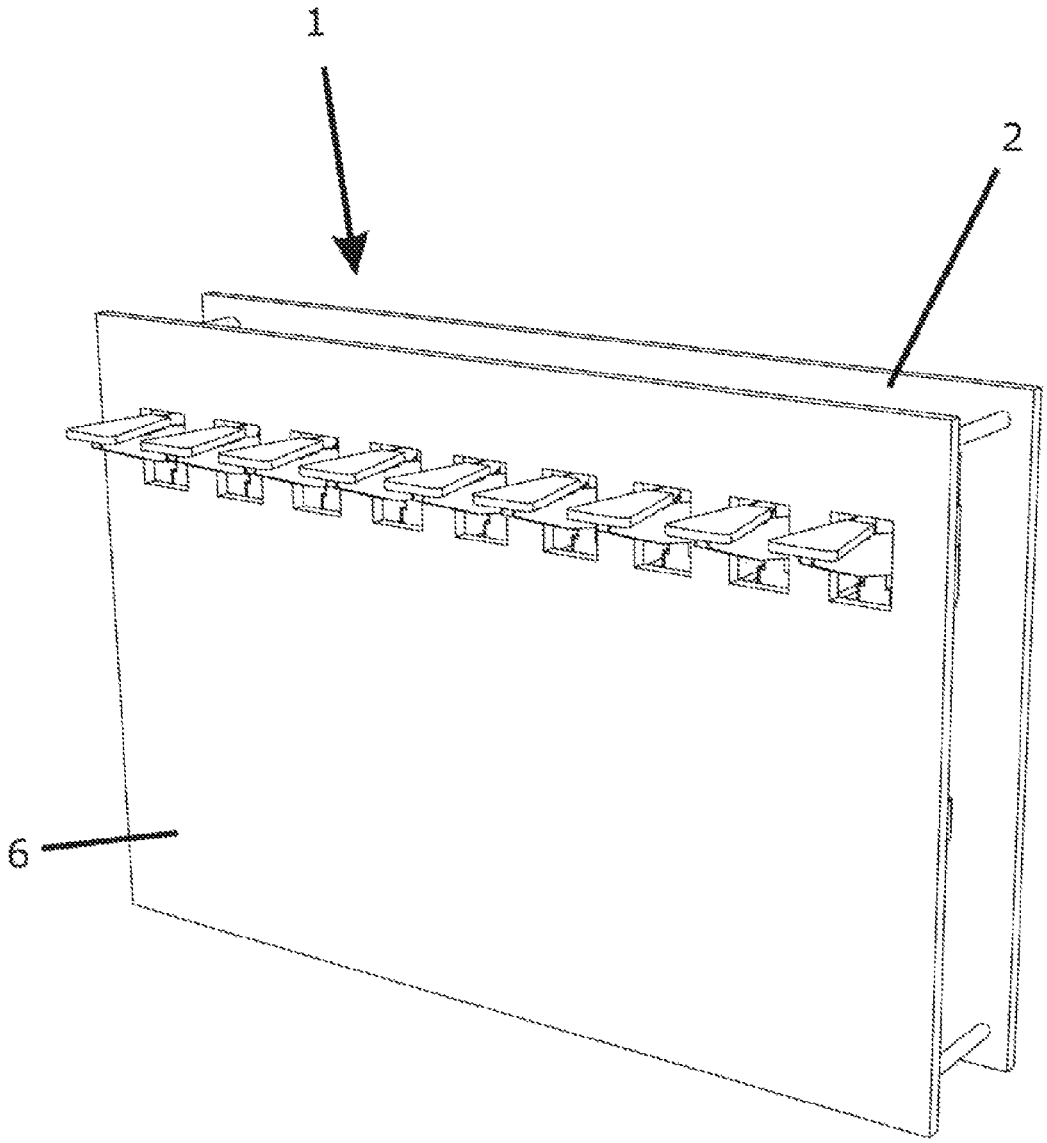
FIG. 14 illustrates an optional version of the musical instrument mechanically activated, in a perspective view.
Figure 15:
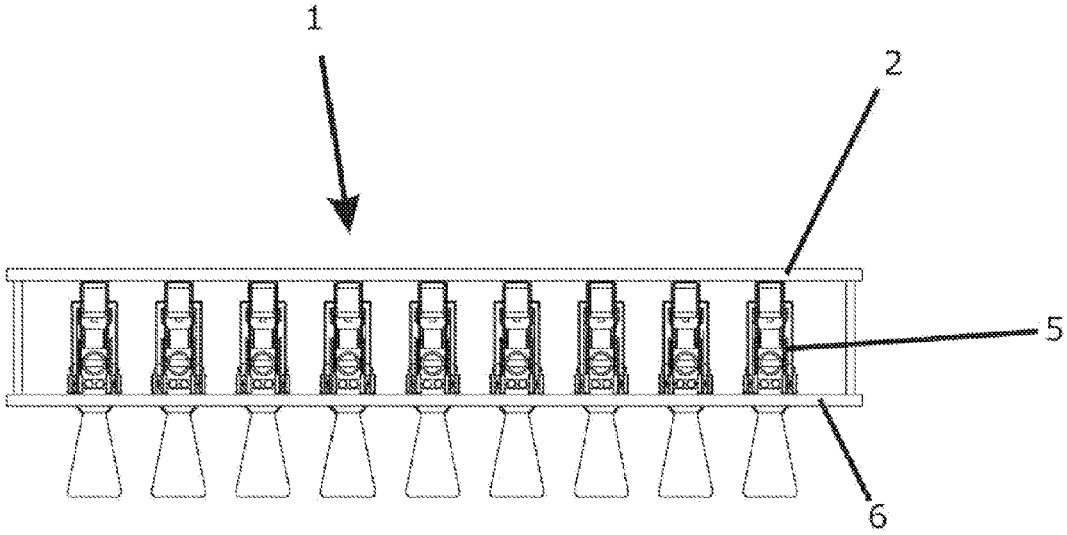
FIG. 15 illustrates the optional version of FIG. 14, in a top view.
Figure 16:
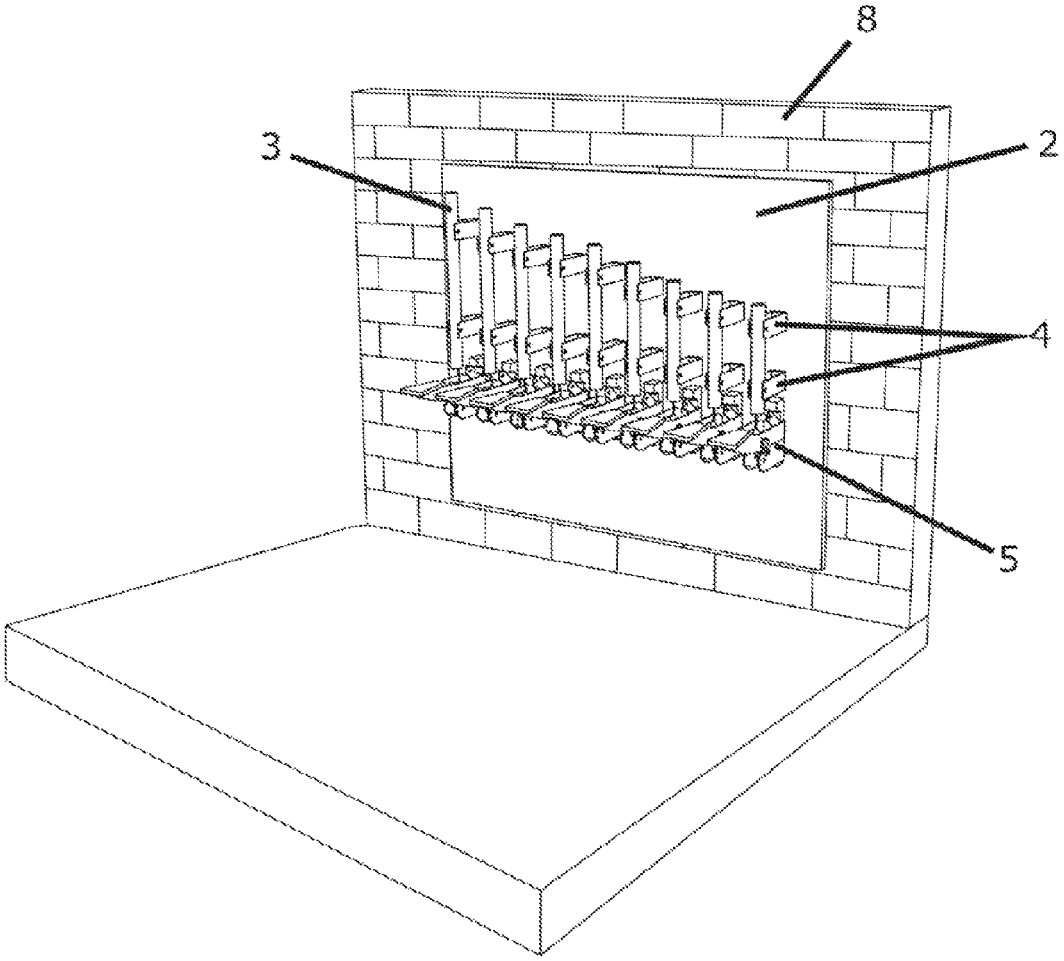
FIG. 16 illustrates the first version of the musical instrument mechanically activated, virtually attached to a wall.
Figure 17:
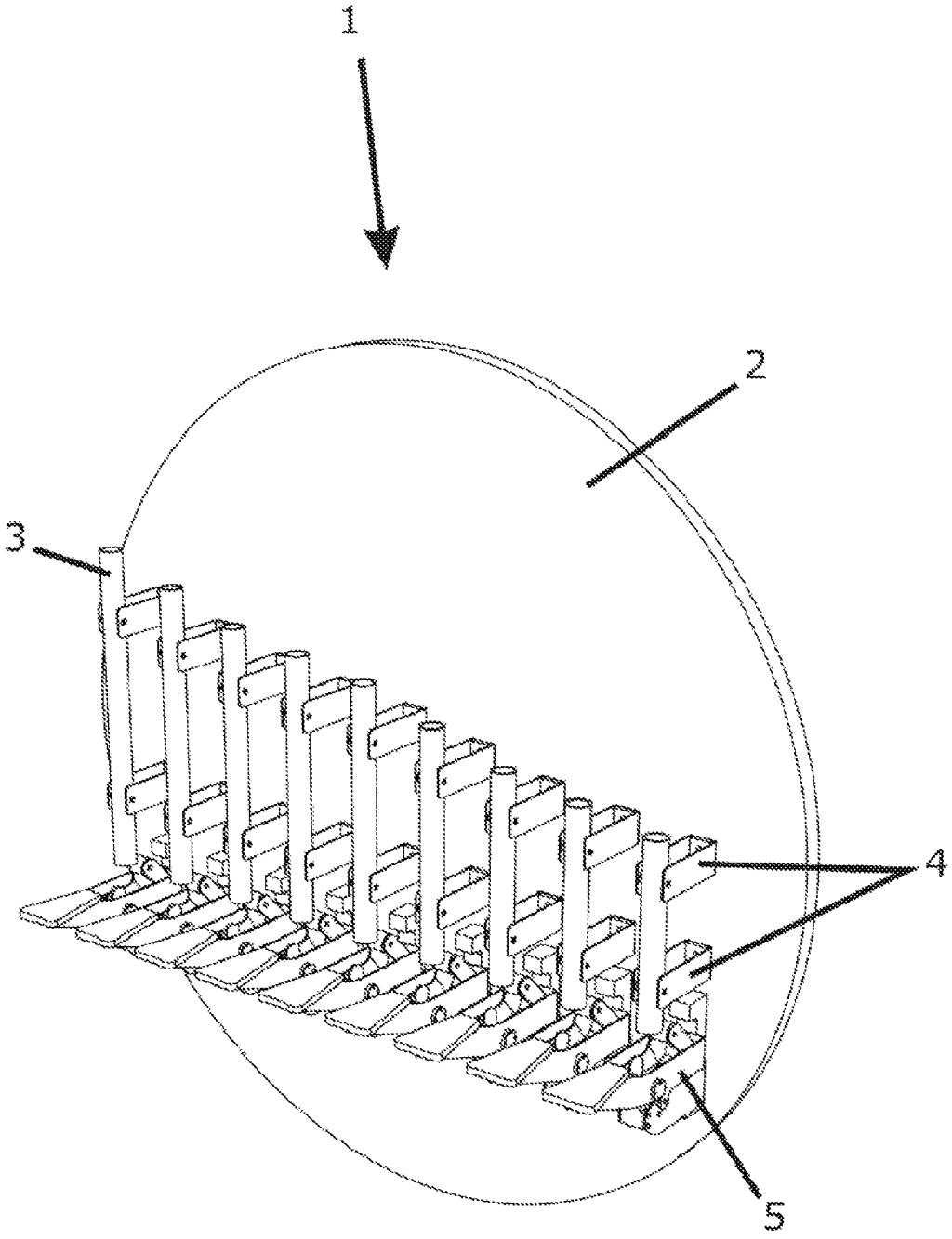
FIG. 17 illustrates the third version of the musical instrument mechanically activated, in a perspective view.
Figure 18:
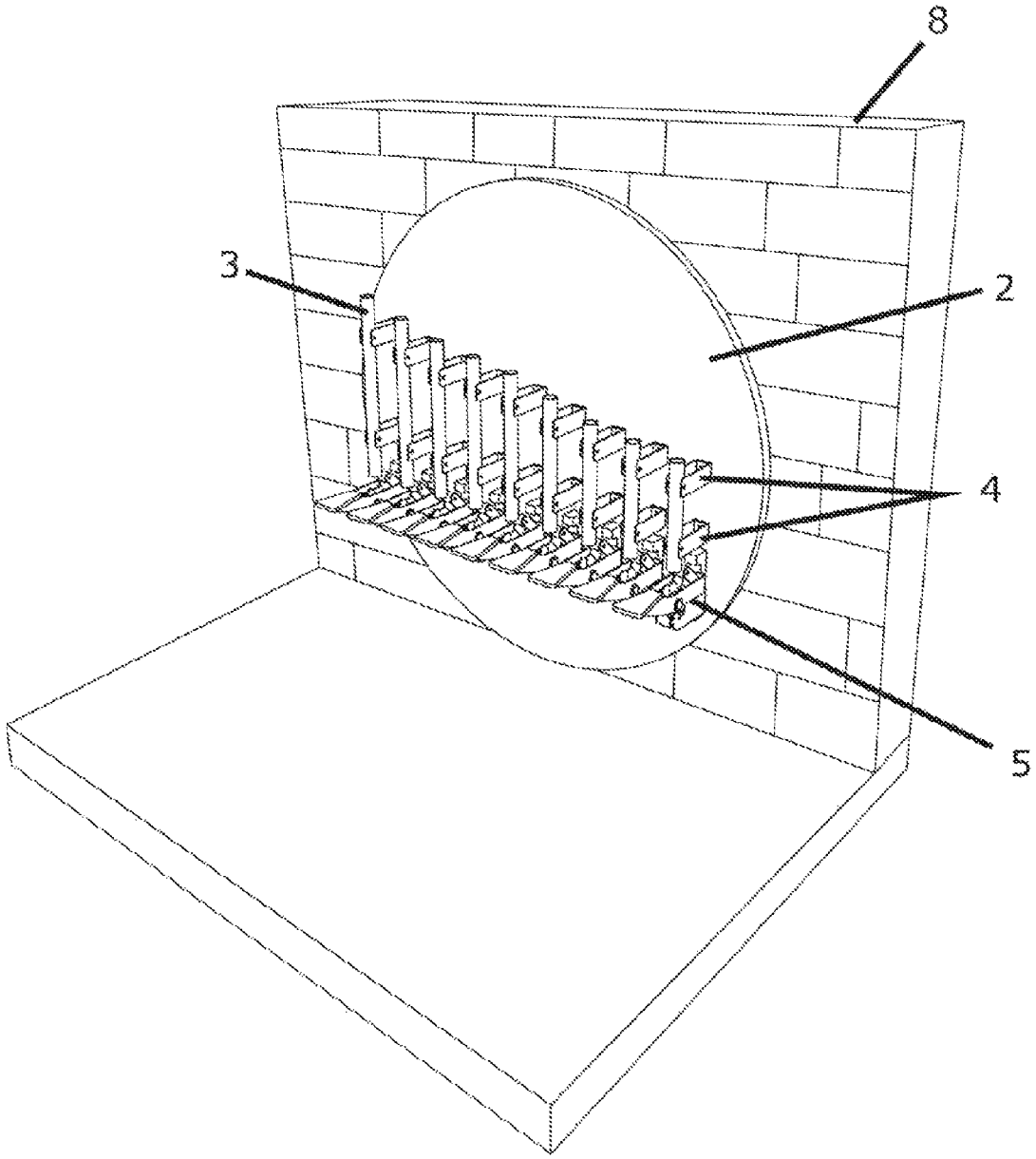
FIG. 18 illustrates the third version of the musical instrument mechanically activated, virtually attached to a wall.
Figure 19:
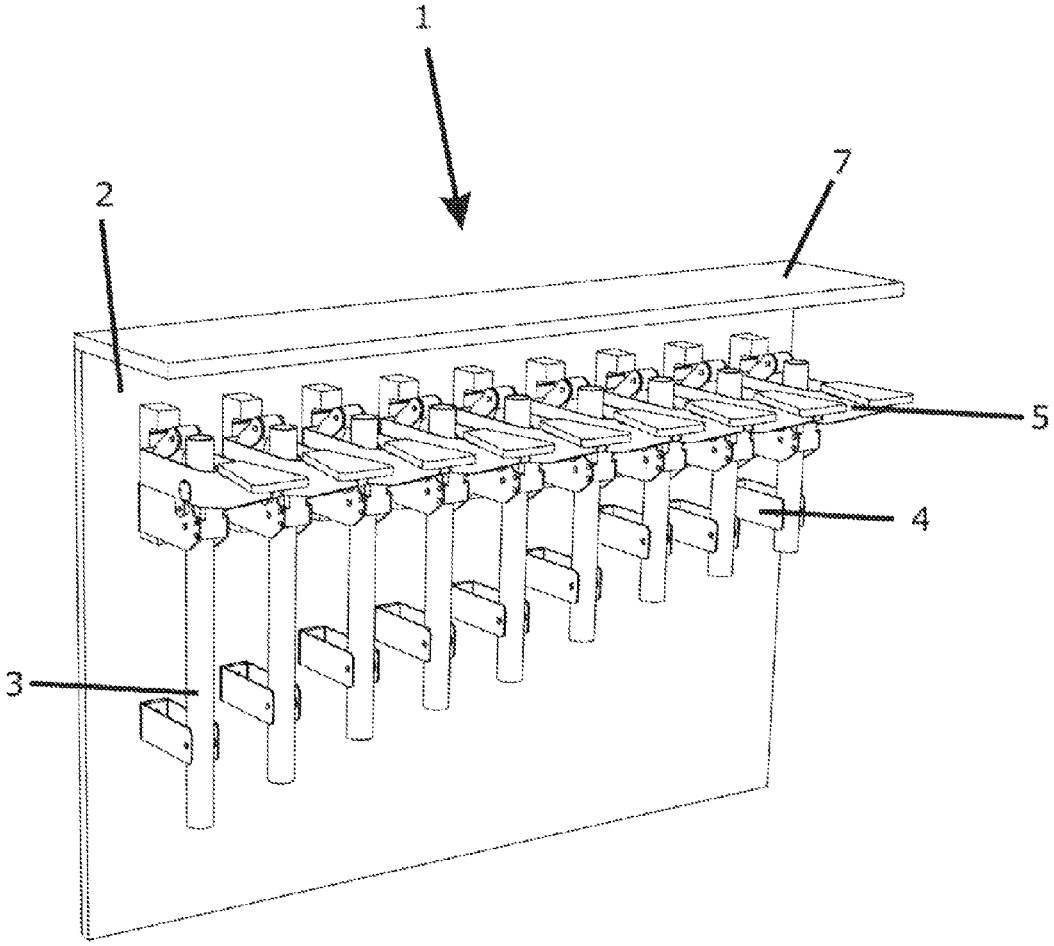
FIG. 19 illustrates the fourth version of the musical instrument mechanically activated, in a perspective view.

The content shown in the figures listed above is purely illustrative, not limiting the inventive concept disclosed below.

DETAILED DESCRIPTION OF THE INVENTION

Based on the figures listed above, the musical instrument mechanically activated, hereafter simply referred to as the instrument (1), consists basically of a sustentation structure (2), of multiple sound tubes (3), of multiple support structures (4) and of multiple actuation mechanisms (5).

The instrument (1) has a unique configuration in which the multiple sound tubes (3), the multiple support structures (4) and the multiple actuation mechanisms (5) are arranged on one of the faces of the sustentation structure (2). In this embodiment, the multiple tubes (3) are arranged parallel to the face of the sustentation structure (2). Optionally, damping elements (not shown) may be introduced between the multiple support structures (4) and the sustentation structure (2). In the same way, damping elements (not shown) may also be introduced between the multiple actuation mechanisms (5) and the sustentation structure (2).

The sustentation structure (2) consists preferably of a monoblockic type plate. Optionally, the sustentation structure (2) may be composed of a plurality of elements attached to each other, spaced or not spaced.

The sustentation structures (2) illustrated in the figures comprise rectangular and circular perimeters, however, these perimeters are not limiting, that is, an sustentation structure (2) may or may not comprise different perimeters based on geometric shapes.

Each sound tube (3) is arranged vertically, in a parallel manner to the sustentation structure (2). The sound tubes (3) are horizontally aligned to each other.

Each sound tube (3) provides at least one horizontal channel (3.1) for fixation purposes.

The spacing between each sound tube (3) as well as the amount of tubes varies according to the project needs. It should also be observed that the height and diameter of the mentioned sound tubes (3) diverges according to the project needs.

The sound tubes (3) are attached to the instrument (1) through support structures (4). Basically, each support structure (4) consists of a "U" shaped profile. Optionally, the sound tubes (3) may also be fixed, in part, by its respective actuation mechanisms (5).

Each support structure (4) provides at least one horizontal axis (4.1) for fixation purposes.

The alignment of the support structures (4) is variable, and this variation is primarily related to the length of the sound tubes (3).

The multiple actuation mechanisms (5) are arranged in a horizontally aligned direction, forming a single line.

As mentioned above, the line of multiple actuation mechanisms (5) may be arranged near the upper or lower ends of the sound tubes (3). Regardless of this arrangement, the function and constructiveness of the multiple actuation mechanisms (5) is always the same, that is, to promote a physical contact of the contact element (5.10) with the sound tubes (3) to generate sonorous vibrations.

Each actuation mechanism (5) is basically composed of fixed elements and movable elements.

The fixed elements consists of at least an attachment structure (5.1), at least a damping structure (5.2), at least a locking structure (5.3), at least a brake (limit of movement) structure (5.4), at least a central shaft (5.5), at least an external articulation (5.6) and at least an internal articulation (5.7).

The locking structure (5.3) and the brake structure (5.4) can be replaced by equivalent means, for example, screws, staples and physical deformations obtained by mechanical engravings.

The movable elements consist of at least one external arm (5.8), at least one internal arm (5.9), at least one contact element (5.10), at least one key (5.11) and at least one impulse element (5.12).

The attachment structure (5.1) comprises a "U" shaped profile, and has the function of fixing the actuation mechanism (5) to the sustentation structure (2). The attachment structure (5.1) can also provide at least a horizontal axis (5.1') (similar to the horizontal axis (4.1) of the support structure (4)) for an optional attachment of a sound tube (3), the said optional attachment related to the position of an actuation mechanism (5) in relation to its respective sound tube (3).

The damping structure (5.2), which is fixed inside the attachment structure (5.1) by means of the locking structure (5.3), serves to limit and damp the forward and return movement of the external arms (5.8). Preferably, the damping structure (5.2) is made of an elastomeric alloy.

The central axis (5.5), which is physically coupled to the attachment structure (5.1) by means of the brake structure (5.4), has the function of supporting, centralizing and bearing the articulations (5.6) and (5.7).

The articulations (5.6) and (5.7) comprise, preferably, ball bearings.

Each external arm (5.8), located between an external articulation (5.6) and an internal arm (5.8), comprises a profile with a fundamental "L" format and a lower (5.13) centrally positioned tab. In a preferred embodiment, the instrument (1) provides two external arms (5.8), which have the function of supporting the key (5.11) and to impulse the internal arms (5.9).

Each internal arm (5.9), located between an external arm (5.8) and an internal articulation (5.7), comprises a perimeter element preferably "L" shaped. In a preferred embodiment, said instrument (1) provides two internal arms (5.9), which have the function to support the contact element (5.10) and to impulse it, so that it enters into physical contact with a tube (3) and generate sonorous vibrations.

The contact element (5.10), designed to establish the physical contact with its respective tube (3), is attached between the free ends of the internal arms (5.9), being always lined up (tangential alignment) to its respective tube (3).

Preferably, the contact element (5.10) consists of a body made of a polymer alloy, especially polyurethane. The choice of the material, which is manufactured with different densities, is important because it has been found that the sound volume is directly proportional to its density. With this option, it is possible to get sonorous vibrations which are audible only to the user who plays the musical instrument (1). This option is extremely interesting when it is not desired to produce a very loud sound.

Each impulse element (5.12) is attached to the lower tab (5.13) of an external arm (5.8).

The operation of each actuation mechanism (5) is simple and practical.

The key (5.11), when pressed by manual actuation, either by open hand or closed hand, articulates the external arms (5.8), which in turn articulates the internal arms (5.9), and the transmission of this articulation movement occurs due to the existence of the impulse elements (5.12), which "push" the mentioned internal arms (5.9).

The angular movement of the external arms (5.8) is limited (both in advance and in return movements) by the damping structure (5.2). However, the movement of the internal arms (5.9) is not limited by the damping structure (5.2), and thus, because of the continuation of the angular movements of mentioned internal arms (5.9), the contact element (5.10) (which is attached between the internal arms (5.9)) is allowed to hit its respective sound tube (3) generating sonorous vibrations, the audible volume being directly proportional to the force applied to the key (5.11).

After the shock of the contact element (5.10) with its respective sound tube (3), the internal arms (5.9) return, by gravity, to its initial position. Also the external arms (5.8), and consequently the key (5.11), return to its normal positions, also by gravity, as soon as the key (5.11) is released.

By means of the illustrative figures, it is possible to realize that, regardless of the position of the multiple actuation mechanisms (5)—being it close to the higher or to the lower ends of the sound tubes (3)—each sound tube (3) remains positioned within the perimeter delimited by the external arms (5.8), the key (5.11) and the contact element (5.10), that is, the constructiveness of each actuation mechanism (5) allows its respective sound tube (3) to be protected and always centrally positioned.

This feature further allows that the elements of each actuation mechanism (5), with obvious exception of the key (5.11), become inaccessible to users, which ultimately will inhibit and hinder urban vandalism.

In addition to this immense advantage, the position of the multiple actuation mechanisms (5) (position relative to the sound tubes (3)) provides versatility to the instrument (1), because said actuation mechanisms (5) may be affixed at any height of the sound tubes (3).

Optionally, the instrument (1) as described above may also provide a front plate (6), this plate being positioned parallel to the sustentation structure (2) in order to protect the elements that make up said instrument (1). The front plate (6) has rips, lined up or not, for access to the keys (5.11). In this configuration, only the keys (5.1) are accessible and visible. The front plate (6) may be opaque or translucent, allowing visualization of the elements that compose the instrument (1).

Still optionally, the instrument (1) may further provide at least one structure (7) in the form of a ruler, groove or similar, attached to the sustentation structure (2), intended to hold objects in general, besides the upper protection of the actuation mechanisms (5).

The sustentation structure (2) of said instrument (1) may optionally expose characters and figures (such as, for example, advertisements, ads or even musical scores) on one or on both sides. These characters may consist of adhesives, paintings and the like.

In this configuration, the sustentation (2) may or may not present holes or passing rips, sinuous or not, which may or may not include the arrangement of characters or figures.

It is also worth mentioning that the instrument (1), both in its main model and in its optional variations, may be attached to a vertical building (8), wall or similar. In this type of assembly, fixation structures (2.1) may be used, which are arranged on the rear side of the instrument (1). The instrument (1) may be mounted perpendicularly to the ground, with or without the use of one or more support structures (2.2) (for example, poles or similar products).

The invention claimed is:

1. A mechanically activated musical instrument comprising:

a musical instrument having a sustentation structure (2), multiple sound tubes (3), multiple support structures and multiple actuation mechanisms (5), said musical instrument (1) having a configuration in which the multiple sound tubes (3), the multiple support structures (4) and the multiple actuation mechanisms (5) are arranged on one side of the sustentation structure (2); the multiple sound tubes (3) arranged parallel to the face of the sustentation structure (2); and, damping elements which are optionally inserted between the multiple support structures (4) and the sustentation structure (2) and also optionally inserted between the multiple actuation mechanisms (5) and the sustentation structure (2).

2. The mechanically activated musical instrument of claim 1 wherein the sustentation structure (2) consists of a monoblockic type plate; the sustentation structure (2) optionally having different perimeters optionally based on geometric shapes.

3. The mechanically activated musical instrument of claim 1 wherein the sustentation structure (2) is composed of a plurality of elements coupled to each other, spaced or not spaced from each other.

4. The mechanically activated musical instrument of claim 1 wherein each sound tube (3) is arranged vertically, parallel to the sustentation structure (2); the sound tubes (3) being aligned to each other in a horizontal direction.

5. The mechanically activated musical instrument of claim 1 wherein each support structure (4) has a "U" shaped profile.

6. The mechanically activated musical instrument of claim 1 wherein said sound tubes (3) are attached to the musical instrument (1) through the support structures (4) and optionally attached, in part, by respective actuation mechanisms (5); the position of said support structures (4) being variable in relation to the length of the sound tubes (3).

7. A mechanically activated musical instrument comprising:

a musical instrument having a sustentation structure (2), multiple sound tubes (3), multiple support structures and multiple actuation mechanisms (5), said musical instrument (1) having a configuration in which the multiple sound tubes (3), the multiple support structures (4) and the multiple actuation mechanisms (5) are arranged on one side of the sustentation structure (2); the multiple sound tubes (3) arranged parallel to the face of the sustentation structure (2);

wherein each actuation mechanism (5) is composed of fixed elements and movable elements; wherein the fixed elements consist of at least one attachment structure (5.1), at least one dampening structure (5.2); at least one locking structure (5.3), at least one brake structure (5.4), at least one axis (5.5), at least one external articulation (5.6) and at least one internal articulation (5.7); and wherein the movable elements consist of at least one external arm (5.8), at least one internal arm (5.9), at least one contact element (5.10), at least one key (5.11) and optionally at least one impulse element (5.12).

8. The mechanically activated musical instrument of claim 1 wherein the multiple actuation mechanisms (5) are horizontally aligned, and form a single line.

9. The mechanically activated musical instrument of claim 1 wherein the multiple actuation mechanisms (5) are arranged close to the upper or lower ends of said sound tubes (3).

10. The mechanically activated musical instrument of claim 7 wherein the attachment structure (5.1) comprises a "U" shaped profile and provides at least a horizontal axis (5.1'); the articulations (5.6) and (5.7), comprise ball bearings.

11. The mechanically activated musical instrument of claim 7 wherein said musical instrument (1) has two external arms (5.8) and two internal arms (5.9).

12. The mechanically activated musical instrument of claim 7 wherein the damping structure (5.2) is made of an elastomeric alloy.

13. The mechanically activated musical instrument of claim 7 wherein the contact element (5.10) is tangentially aligned relative to a respective sound tube (3), at the moment of contact with that sound tube (3).

14. The mechanically activated musical instrument of claim 13 wherein the contact element (5.10) consists of a body made of a polymeric alloy.

15. The mechanically activated musical instrument of claim 14 wherein the polymeric alloy used in the production of the contact element (5.10) consists of polyurethane.

16. The mechanically activated musical instrument of claim 7 wherein each sound tube (3) remains positioned within a perimeter delimited by the external arms (5.8), the key (5.11) and the contact element (5.10).

17. The mechanically activated musical instrument of claim 1 wherein said actuation mechanisms (5) are mounted at any height of the sound tubes (3).

18. The mechanically activated musical instrument of claim 7 further comprising a front plate (6) arranged parallel to the sustentation structure (2); and wherein the front plate (6) has rips for access to the keys (5.11); and wherein the front plate (6) is optionally opaque or translucent.

19. The mechanically activated musical instrument of claim 1 further comprising at least one structure (7) in the form of a ruler, groove or similar structure, attached to the sustentation structure (2).

20. A mechanically activated musical instrument comprising:

a musical instrument having a sustentation structure (2), multiple sound tubes (3), multiple support structures and multiple actuation mechanisms (5), said musical instrument (1) having a configuration in which the multiple sound tubes (3), the multiple support structures (4) and the multiple actuation mechanisms (5) are arranged on one side of the sustentation structure (2); the multiple sound tubes (3) arranged parallel to the face of the sustentation structure (2); and, wherein the sustentation structure (2) exhibits characters and figures on one or on both faces thereof, the sustentation structure (2) optionally provided with roles or passing rips.

21. The mechanically activated musical instrument of claim 20 wherein the characters and figures may consist of adhesives, paintings and the like.

22. The mechanically activated musical instrument of claim 1 wherein said musical instrument is attached to either a vertical building, wall or similar structure (8) or fixed perpendicularly to the ground.

23. The mechanically activated musical instrument of claim 22 further comprising fixation structures (2.1) for attaching the musical instrument (1) to a vertical building, wall or similar structure (8) or one or more support structures (2.2) for fixing said musical instrument (1) to the ground.

24. A mechanically activated musical instrument comprising:

a musical instrument having a sustentation structure (2), multiple sound tubes (3), multiple support structures and multiple actuation mechanisms (5), said musical instrument (1) having a configuration in which the multiple sound tubes (3), the multiple support structures (4) and the multiple actuation mechanisms (5) are arranged on one side of the sustentation structure (2); and, damping elements which are optionally inserted between the multiple support structures (4) and the sustentation structure (2) and also optionally inserted between the multiple actuation mechanisms (5) and the sustentation structure (2).

* * * * *